United States Patent [19]

Dulake

[11] 4,377,051

[45] Mar. 22, 1983

[54] FLYING DEVICES

[76] Inventor: Robert F. Dulake, 69 Hazelmere Gardens, Hornchurch, Essex, England, RM11 2AS

[21] Appl. No.: 260,470

[22] Filed: May 4, 1981

[30] Foreign Application Priority Data

Aug. 15, 1981 [GB] United Kingdom ..... 8026807

[51] Int. Cl.[3] ..... A63H 27/04

[52] U.S. Cl. ..... 46/77

[58] Field of Search ..... 46/77, 76 R, 78, 74 R; 272/31, 46

[56] References Cited

U.S. PATENT DOCUMENTS

| | | | |
|---|---|---|---|
| 2,404,922 | 7/1946 | Padgett | 45/77 |
| 2,538,132 | 1/1951 | Taggert | 46/77 |
| 2,592,971 | 4/1952 | Stewart | 46/77 |
| 2,837,864 | 6/1958 | Bortfeldt | 46/77 |
| 3,802,118 | 4/1974 | Shellhause | 46/77 |
| 3,882,632 | 5/1975 | Quinzer | 46/77 |
| 4,067,139 | 1/1978 | Pinkerton et al. | 46/249 |

OTHER PUBLICATIONS

"Nutnik", *American Modeler,* vol 52, No. 6, Sep. 1959, pp. 12,13.

G. Read, "Keeping Control Line Tension", *Aeromodeller Annual* 1968-1969, pp. 78-80.

*Primary Examiner*—Mickey Yu

*Attorney, Agent, or Firm*—Seidel, Gonda, Goldhammer & Panitch

[57] ABSTRACT

A line controllable model airplane has a main delta wing to provide an aerodynamically induced lift force directed upwardly when the airplane is flying horizontally. An elevator is mounted on the airplane for pivotable movement in a manner to modify the airstream over the delta-wing thereby to vary a vectorial property of the lift force. A pair of control lines are operatively connected to the elevator for effecting pivotable movement thereof. The control lines extend away from one side of the flying device in an unkinked condition and at an angle to the direction of flight. The angle is continuously variable independently of effecting pivotable movement of the elevator. An air deflector is provided to effect an aerodynamically induced lateral force on the airplane in a direction extending away from the other side thereof and at a magnitude sufficent to render any tensioning effect due to centrifugal force in the control lines unnecessary to sustain flight.

11 Claims, 5 Drawing Figures

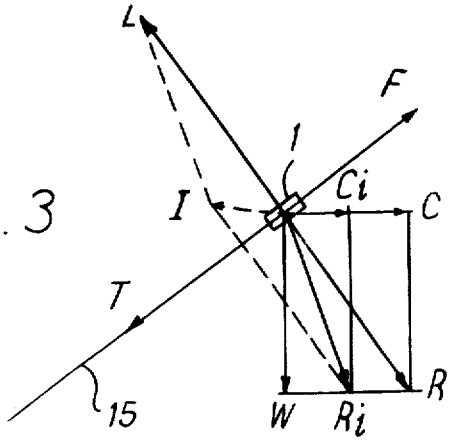
FIG. 3
FIG. 4
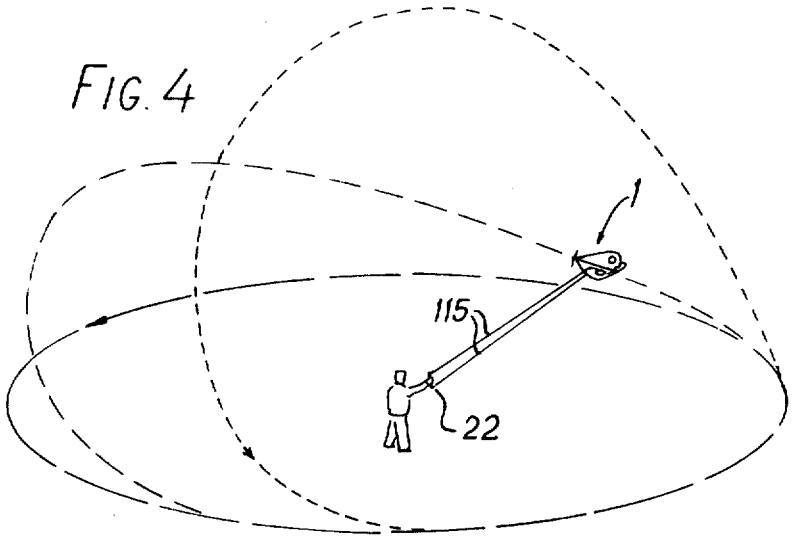
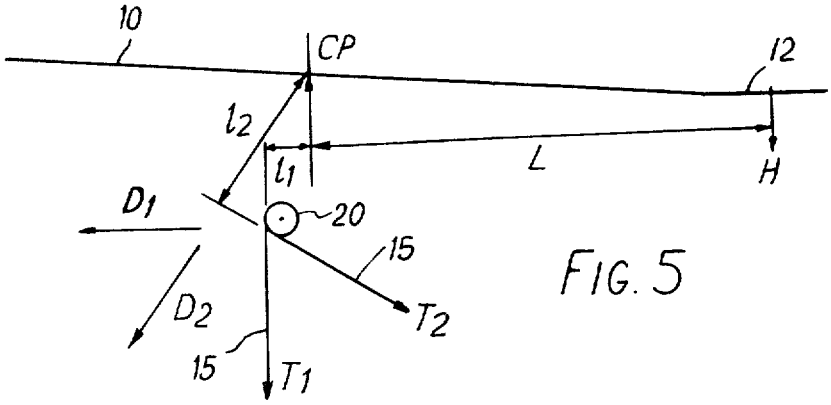
FIG. 5

FLYING DEVICES

This invention relates to flying devices and in particular to flying devices, e.g. working model aeroplanes, used as toys or playthings and of the so-called "tethered" or "line controllable" variety wherein the device has an aileron or elevator movable pivotally in opposite directions (up or down) by two control lines extending from the flying device to an operator on the ground.

Such line controllable flying devices can only be made to execute controlled flying manoeuvres if the control lines are maintained taut. Thus the device is constrained to fly in the generally hemispherical surface centred on the operator and having a radius equal to the length of the two control lines. For ease of control (i.e. to maximise the time and space available for executing controlled manoeuvres) and to avoid operator giddiness, the area of this hemispherical surface, and hence its radius and the length of the control lines, should be as large as possible. However, the latter has in past practice been restricted by the groundspeed of the flying device since this groundspeed and the length of the control lines determine the centrifugal force which, in the past, has been principally responsible for maintaining the control lines in a taut condition, and which has had to be of a sufficient magnitude to maintain the said taut condition against the counteracting effects of (a) gravity when the flying device crossed over the top of the flight hemisphere (b) of wind pressure when the device crossed the upwind portion of the flight hemisphere, and/or (c) of reduction of the said groundspeed when the flying device was in a climbing attitude and or was flying against the wind.

Also in the past, the two control lines extended from the operator through fixed tubes or orifices at the wingtip of the flying device to a pivoted bell-crank mechanism the latter being mounted remote from the aileron or elevator to be controlled, and connected thereto by at least one long rigid wire. This arrangement retained the flying device substantially at a constant angle to the control lines, variation of the said angle being possible only with the inducement of a sudden change of direction or kink in the said control lines at their point of exit from the flying devide through the said wingtip located fixed tubes or orifices.

One prior art proposal for maintaining tension in the lines (see "Aeromodeller Annual 1968–69" pages 78–80), and which might be employed to allow longer control lines to be used, involves weighting the flying device asymmetrically so that the aerodynamically induced lift force on the main wings is directed at miore than 90° to the control lines' tension. However this proposed method has severe practical limitations (particularly where manoeuvres such as "over the top" are to be performed) and involves kinking or making a sudden directional change in the direction of the control lines adjacent to the flying device giving rise to attendant problems and disadvantages, e.g. a tendency to bind and/or fracture of the kinked control lines.

It is thus desirable to provide a line controllable flying device employing control lines having a longer length than heretofore, and/or having no kinks or like sudden directional transitions therein.

According to one aspect of this invention there is provided:

A line controllable flying device comprising first air deflection means to effect on the flying device an aerodynamically induced "lift" force directed upwardly when said device is flying horizontally, second air deflection means mounted for pivotal movement in a manner to modify the airstream over said first air deflection means thereby to vary the magnitude and/or direction of said "lift" force, and a pair of control lines operatively connected to said second air deflection means for effecting said pivotal movement thereof, and for extension away from one side of the flying device, characterized by the provision of third air deflection means to effect an aerodynamically induced lateral force on the flying device in a direction extending away from the other side of the flying device, of a magnitude sufficient to augment substantially any tension force component in the control lines due to centrifugal force. Preferably said lateral force is of a magnitude sufficient to render any tensioning effect due to centrifugal force unnecessary to sustain controlled flight of the flying device. Advantageously the area of the third air deflection means is at least one-third, preferably of the order of two-thirds, of the area of the first air deflection means.

Advantageously, there is provided, in association with said third air deflection means, fourth air deflection means (e.g. in the form of a so-called 'reflexed' trailing edge or of an offset rudder preferably attached to the rear of said third air deflection means) to maintain an air induced turning force or moment upon said flying device in a direction tending to turn said flying device in a direction outwardly and away from the arcuate path of motion in which the flying device is constrained to fly. Said offset rudder may be positionally fixed or movable. Instead of being attached to the rear of said third air deflection means, the fourth air deflection means may be disposed on said other side of the flying device.

It will be understood that varying the magnitude and/or the direction of any force or airflow is equivalent to varying a vector or vectorial property of that force or airflow.

According to another aspect of this invention there is provided:

A line controllable flying device comprising first air deflection means to effect on the flying device an aerodynamically induced "lift" force directed upwardly when the device is flying horizontally, second air deflection means mounted for pivotal movement in a manner to modify the airstream over said first air deflection means whereby to vary the magnitude and/or direction of said "lift" force, and a pair of control lines operatively connected to said second air deflection means for effecting said pivotal movement thereof and for extension away from one side of the flying device, characterized in that said control lines can extend as aforesaid in unkinked condition and at an angle to the direction of flight of the flying device, said angle being continuously variable independantly of effecting pivotal movement of said second air deflection means.

Preferably, and in accordance with either aspect of this invention, each of the two opposite main surfaces of said second air deflection means has a member projecting away therefrom, the free ends of said two members are operatively connected to the two control lines respectively, said control lines passing around associated pulley wheels mounted on the device and from said pulley wheels to extend as aforesaid away from said one side of the flying device. The control lines may be connected directly to said members or via a bell crank mechanism operative between the pulley wheels and said members.

Advantageously said pulley wheels are mounted co-axially on said first air deflection means and forwardly of said second air deflection means.

Preferably (and in accordance with both said aspects of this invention combined) the common axis of said coaxial pulley wheels is located on said first air deflection means at a position that is offset laterally towards said one side of the flying device, and is forward of the so-called "centre of pressure" of the third air deflection means. This so-called "centre of pressure" is the theoretical point at which the said aerodynamically induced lateral force on said third air deflection means may be deemed to act.

Conveniently said first air deflection means comprises one or more wings and said second air deflection means comprises at least one aileron or elevator.

By way of non limiting example, a line controllable model aeroplane according to this invention will now be described, reference being made to to the accompanying drawings of which:

FIG. 3 is an empirical vector diagram showing relevant forces considered to be involved in flying the model aeroplane of FIGS. 1 and 2;

FIG. 4 is a schematic perspective view of possible flight paths that can be taken by the model aeroplane of FIGS. 1 and 2; and FIG. 5 is a diagramatic representation of relevant turning moments considered to be involved whilst the model aeroplane of FIGS. 1 and 2 is in flight.

Figure 1:
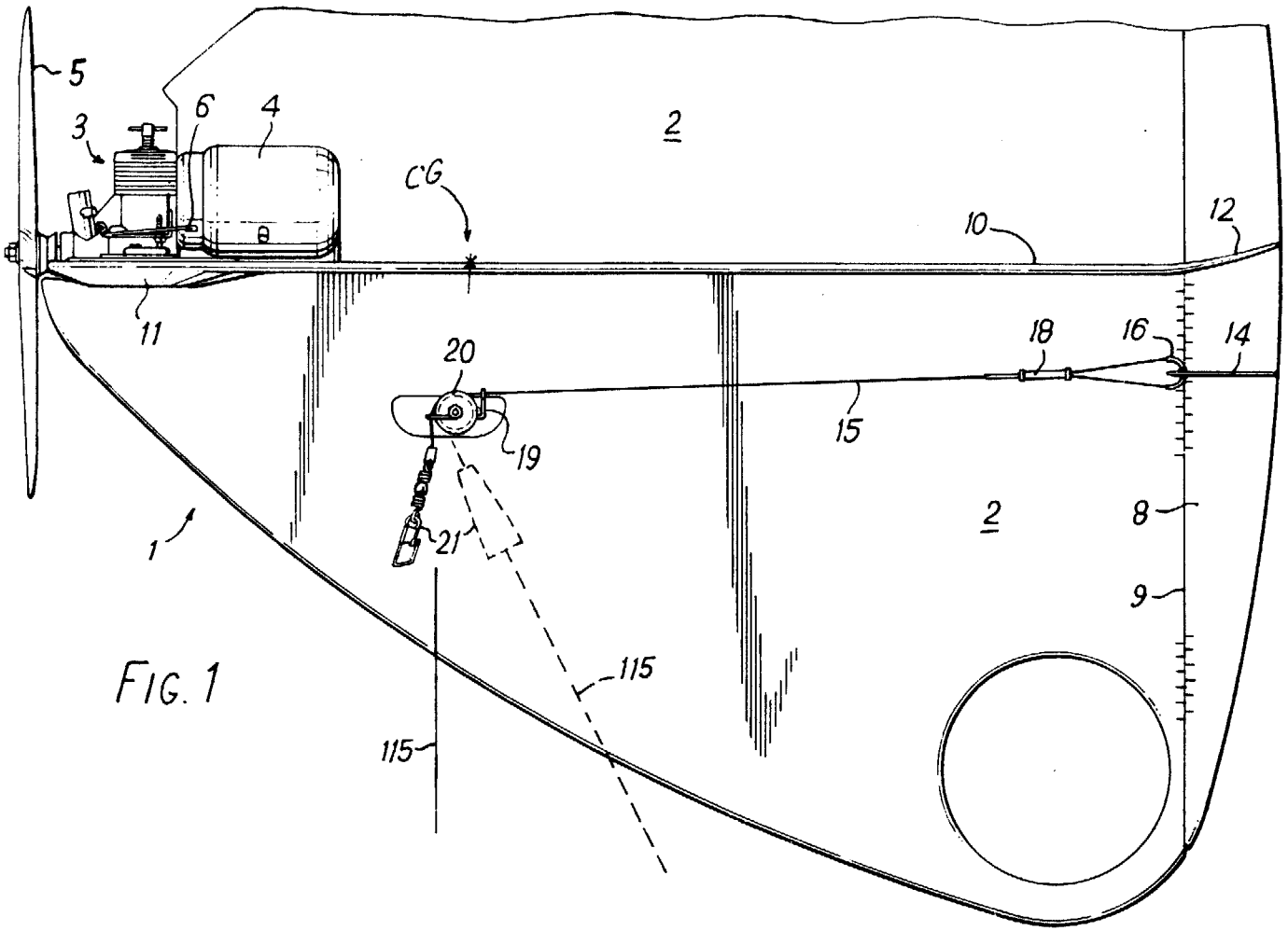
FIG. 1 is a plan view of part of the model aeroplane embodying this invention.
Figure 2:
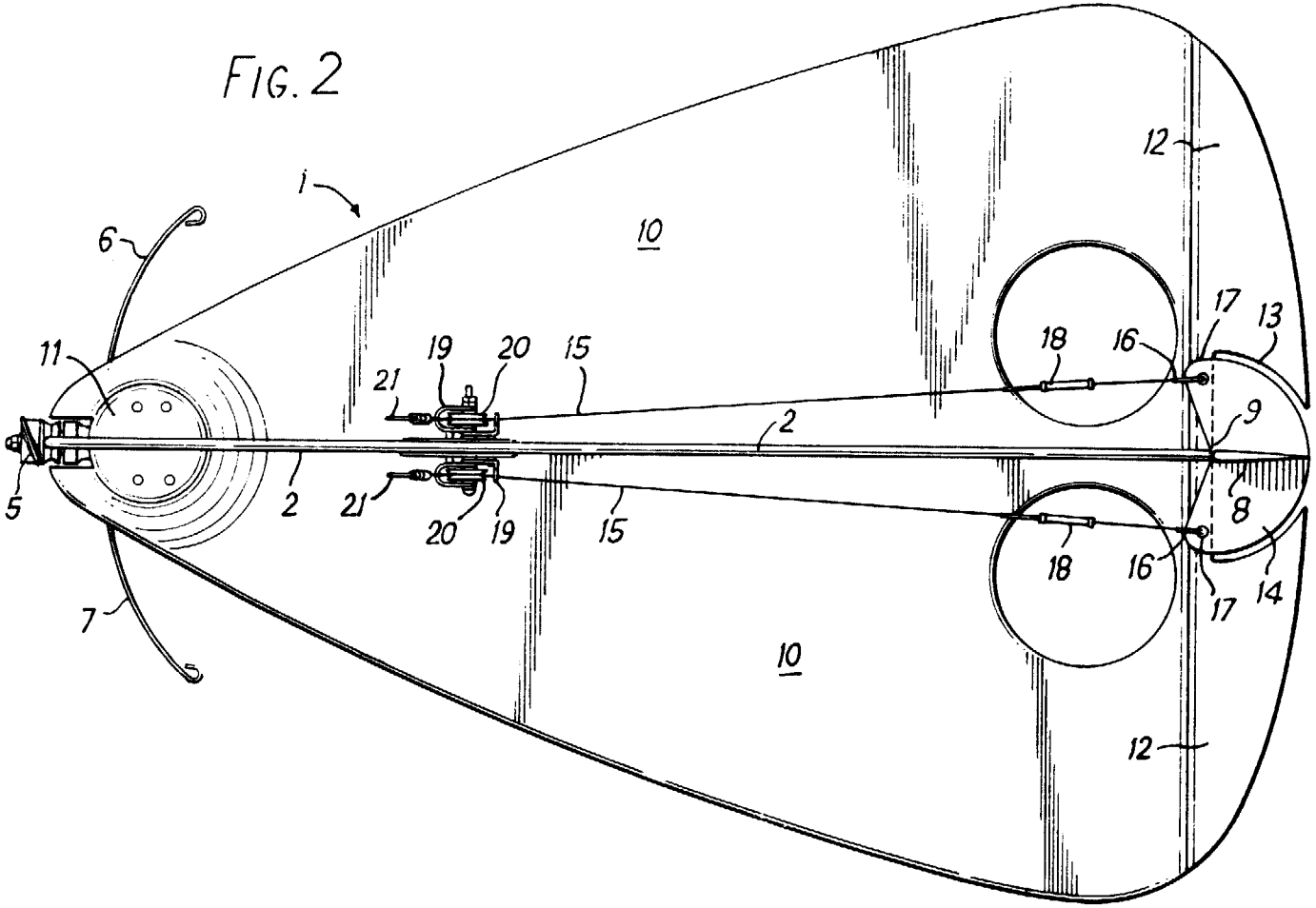
FIG. 2 is a side elevation of the model aeroplane of FIG. 1.

As shown in FIGS. 1 and 2, the model aeroplane 1 comprises a main delta-shaped wing 2 of generally flat aerofoil section. An engine 3 is mounted at the apex or nose of wing 2 and slightly off-axis towards the outside of the model (omitted from the top of FIG. 1). The engine 3 is a small (e.g. 2½ cc capacity) single cylinder internal combustion diesel engine capable of providing a propulsive thrust equal to at least 1½ times the weight of the complete model 1. A fuel tank 4 of the so-called "clunk" type, i.e. having a bob-weight controlled fuel feed to the engine, is mounted rearwardly of the engine 3 and in line therewith.

A propellor blade 5 is mounted on the output shaft of engine 3. Two oppositely-directed resilient metal spokes 6, 7 of arcuate shape are mounted on the outside of engine 3, one spoke 6 extending rearwardly and upwardly and the other spoke 7 extending rearwardly and downwardly. These resilient metal spokes serve as skids tending to prevent damage to the balsa wood airframe of the model aeroplane 1.

A secondary "wing" of aerofoil section is mounted pivotally to the rear edge of wing 2 so as to form an aileron or elevator 8. The pivotal connection between wing 2 and elevator 8 is by means by lengths of flexible filaments (e.g. fishing line) sewn or stitched to the top and underside of the respective members in such a way that each filament leaving the top of elevator 8 is connected to the underside of wing 2 and vice versa. In this way a strong pivotal axis or hinge line 9 with very low friction is formed. The location and density or stitch spacing of the stitching is arranged to provide maximum support to the areas of hinge receiving highest stress.

A third air deflection part provided for the illustrated model aeroplane is a delta shaped fin 10 of flat aerofoil section extending to each side of the wing 2 and generally at right angles thereto. The delta-shaped fin 10 has the same length as wing 2 and has its lateral dimensions relatively reduced, e.g. by a factor of at least ⅓, preferably of the order of ⅔. The nose of fine 10 is reinforced as at 11 to provide a rigid mounting for the engine 3, and the trailing edge portion of fin 10 is angled or reflexed outwards, e.g. at between $\tan^{-1} 0.08667$ and $\tan^{-1} 0.1667$ to provide a fixed reflexed trailing edge 12 forming a so-called stabilizer for fin 10.

The reflexed trailing edge 12 is apertured at 13 to allow the aileron or elevator 8 to pass therethrough and pivot freely.

A flat fin-like member 14 extending at right angles away fom the two opposite sides of the aileron or elevator 8 is secured thereto at a location spaced a short lateral distance inwardly of the reflexed trailing edge 12 (see FIG. 1). The member 14 is substantially coplanar with two control lines 15 connected to the two free ends of member 14 remote from aileron or elevator 8 and extending therefrom towards the rims of two pulley wheels 20. The mode of attachment of each control line 15 to member 14 is to pass an end portion of the control line through a horseshoe shaped piece of narrow guage brass tubing threaded through a reinforced bush 17 at the respective free end of member 14, the leading and trailing parts of said end portion being clenched or tied together forwardly of said member as at 18. This mode of attachment avoids undue kinking of the control line (which is conveniently of fishing line material) and any consequential binding and/or fracture thereof.

Each control line 15 extends from location 18 forwardly to and around its respective pulley wheel 20, mounted one above and one below the wing 2. The two pulley wheels 20 are co-axial, their common axis being located a very small distance forwardly of the centre of gravity of the model (which is in turn located at the approximate position of the centre of (aerodynamic) pressure of fin 10) and laterally inwardly from the central fin 10 by a distance of approximately 1/7 times the maximum chord of wing 2.

The two pulley wheels 20 are movable independently of one another, and each is provided with a rigid wire guide 19 to retain the associated control line 15 in the groove of the respective pulley wheel 20.

The two control lines 15 extend from the pulley wheels 20 away from the central fin 10 of the model aeroplane 1 and in an inwards direction, i.e. towards the centre of the hemispherical surface in which the aeroplane is constrained to fly (by the length of the two control lines 15), and are terminated by swivel-equipped fasteners 21 of the type used for angling purposes. Stranded steel wires 115 are connected to said fasteners 21 to provide extensions of said control lines 15 extending to a 'U' shaped operator-held control 22 (see FIG. 4). Upwards and downwards movement of the model aeroplane in said hemispherical surface is achieved by the operator rocking control 22, i.e. in effect pulling on one stranded steel wire extended control line 15 and releasing correspondingly the other stranded steel wire extended control line 15, thereby imparting a pivotal motion to member 14 and corresponding pivotal movement of aileron or elevator 8 about the pivot axis 9. Such pivotal movement of aileron or elevator 8 effects a modification of the airflow over the upper and/or lower surfaces of wing 2 and thus varies the aerodynamically induced lift force imparted to the model aeroplane by the wing 2.

Another quite separate aerodynamically induced force acts on the model, this being the lateral, outwardly directed force due to the airflow over the aerofoil section fin 10 stabilised to said airflow at an angle that is always positive. It is considered that this stabilisation is due to the opposing moments or turning forces about the centre of pressure CP (or possibly the approximately co-incident centre of gravity) due to the control line tension T and the aerodynamically induced force H on the reflexed trailing edge 12 (see FIG. 5). Apparently these oppositely acting moments normally counterbalance one another so that $H \times L = T_1 \times l_1$. If, for example, due to a sudden gust of wind $T_1$ falls to lower level $T_2$ then it is apparently the moment $H \times L$ that causes the model 1 to rotate about CP (or CG) until the model adopts an attitude in which the moments $H \times L$ and $T_2 \times l_2$ are in counterbalance. Thus, it is apparently due to the fixed position reflexed trailing edge 12 and the pulley wheels 20 that the model 1 continuously varies its angle of attack to the circular path of movement in which it is constrained to fly (indicated in FIG. 5 by the instantaneous tangents $D_1$ and $D_2$ respectively for line tensions $T_1$ and $T_2$).

The fin 10 is designed such that, stabilised as described above, the aerodynamically induced lateral force is always at least equal to the weight of the model 1, irrespective of the position of the model on the surface of the flight hemisphere. Thus the model is capable of executing "over the top" manoeuvres without the aid of centrifugal force, the actions of the wing 2 and fin 10 being, in effect, interchanged as the model flies, "over the top" and is instantaneously in the "top dead centre" position immediately overhead of the operator.

It will be appreciated that the outwardly directed lateral force on model 1 acts generally in, or at a small angle to, the direction of any centrifugal force. Whereas in the past the length of the control lines, i.e. the radius of the hemispherical surface, was limited by the groundspeed of a model and its associated centrifugal force (which latter was proportional to the square of the groundspeed and inversely proportional to the hemisphere radius or control line length), the illustrated model aeroplane 1, by means of fin 10, provides for a lateral force to be aerodynamically induced in an outward direction at all points on the hemispherical flying surface and whatever manoeuvres is being executed by the model, e.g. flying simply horizontally or flying "over the top" or even flying upside down (if the aerofoil section of wing 2 permits this). Moreover, this continuously present lateral force (when the model 1 is flying) is of a magnitude not only sufficient to augment any existing centrifugal force but sufficient to supplant it when it would otherwise be insufficient to maintain the model in flight. This is illustrated schematically in FIG. 3 where the small centrifugal force C (due to very long control lines 15) and the model's weight W have a resultant R that is equal and opposite to the lift force L aerodynamically induced by the wing 2. Theoretically, with any smaller value of C, e.g. $C_1$, the resultant of forces $C_1$ and W would be $R_1$ which, with L, would give a final resultant force I acting inwardly, i.e. there would be no tensioning force on the control lines 15 at all and the model would fly out of control (and probably fall). In contrast, the aerodynamically induced force F due to fin 10 serves to maintain the tension T in the control lines 15, and the effect of any centrifugal force may be discounted or ignored in comparison. Moreover, the arrangement of the forces acting upon fin 10 is theoretically apparently such that a reduction in the tension of control lines 15, such as may be caused by (1) wind crossing the flight hemisphere in the direction of the control lines from the model to the operator, and/or (2) the model flying across the top of the flight hemisphere, and/or (3) by the model flying at reduced speed during a climbing manoevre, causes the outward turning force or moment $H \times L$ (see FIG. 5) due to reflexed trailing edge 12 to predominate and increase the angle made by fin 10 to the surface of the flight hemisphere, i.e. the model 1 will point more outwardly of the hemisphere.

An increase in line tension, as may be caused by wind blowing in the direction of the control lines from the operator towards the model, apparently causes the moment $T \times l$ due to the line tension to predominate over the turning force $H \times L$ due to reflexed trailing edge 12, reducing the angle made by fin 10 to the surface of the flight hemisphere and relieving control lines 15 of excess load. In extreme cases said angle may become negative whereby model 1 points slightly into the hemisphere.

The above aspects have been borne out by experiments with models (A) and (B) according to this invention which are compared here with traditionally accepted data for prior art devices (a) and (b):

Model (A):
- engine capacity = 2.5 $cm^3$
- estimated airspeed in level flight = 45 M.P.H.
- maximum tested length of taut control lines (steel) = 200 ft.

(This model (A) corresponds to that illustrated in FIGS. 1 an 2)

Model (a):
- (prior art) engine capacity = 2.5 $cm^3$
- estimated airspeed in level flight = 45 M.P.H.
- maximum length of taut control lines = 50–60 ft.

Model (B):
- engine capacity = 0.5 $cm^3$
- estimated airspeed in level flight = 30 M.P.H.
- maximum tested length of taut control lines = 50 ft.

Model (b):
- (prior art) engine capacity = 0.5 $cm^3$
- estimated airspeed in level flight = 30 M.P.H.
- maximum length of taut control lines = 25–30 ft.

It will be appreciated that in the course of each revolution around the operator, model 1 flies cyclically upwind, across wind at the upwind side of the revolution, downwind and across wind at the downwind side of the revolution. This means that during each revolution the model 1 will move smoothly through areas of increased and decreased control line tension as the model passes respectively across the downwind and upwind sides of the revolution.

As previously explained, a reduction of line tension is automatically countered by the model adopting an increased angle to the flight path and vice versa an increase of line tension results in a decrease of said angle. The angle made by the model to the flight path therefore varies from a maximum to a minimum value and back again once in every revolution, in order to maintain the appropriate magnitude and direction of the line tension necessary for control.

Such variations, which are smoothly continuous, can be effected very readily and without kinking or otherwise making sudden directional transitions in the control lines 15 since the lines 15 simply vary correspondingly the angular extent of their engagement of the pulley wheels 20 over which they pass.

Although such variability of the angle of the model to the ditrection of the circular flight path implies a somewhat "crab-like" motion of the model aeroplane 1, due to its being in alignment more nearly with the airflow over itself than to the said circular flight path, it has been found experimentally that this does not impede the exercise of proper control and manoeuvrability of the model aeroplane 1 even when flying with surprisingly long lines 15 of over 100 ft in length, e.g. up to approximately 200 ft in length.

It will be appreciated that although the illustrated embodiment of this invention has wings 2 and fin 10 of corresponding delta-shaped planform, other outline and cross-sectional shapes may be used for generating the models lift force and outwardly directed lateral force respectively. It will also be appreciated that the provision of air deflection means (such as fin 10) to induce aerodynamically an outwardly directed lateral force on the model aeroplane may in some cases enable a smaller engine providing a slower flying speed to be used for the same length of control line (as an alternative to providing a longer length of control line with the same engine and same flying speed).

I claim:

1. A line controllable flying device comprising first air deflection means to effect on the flying device an aerodynamically induced lift force directed upwardly when said device is flying horizontally, second air deflection means mounted for pivotal movement in a manner to modify the airstream over said first air deflection means thereby to vary the magnitude and/or direction or said lift force, a pair of control lines operatively connected to said second air deflection means for effecting said pivotal movement thereof, a pair of like-dimensioned co-axial pulley wheels for enabling said control lines to pass respectively therearound and from said pulley wheels in an unrestricted manner such as to extend from one side of the flying device in unkinked condition and at an angle to the direction of flight of the flying device, said angle being continuously variable independently of effecting pivoted movement of said second air deflection means, third air deflection means to effect an aerodynamically induced lateral force on the flying device in a direction extending away from the other side of the flying device and of a magnitude sufficient to augment substantially any tension force component in the control lines due to centrifugal force, and fourth air deflection means to effect an aerodynamically induced turning force or moment upon said flying device in a direction tending to turn the flying device outwardly of the arcuate path of motion in which it is constrained to fly.

2. A line controllable flying device according to claim 1, wherein said lateral force is of a magnitude sufficient to render any tensioning effect due to centrifugal force unnecessary to sustain flight of the flying device.

3. A line controllable flying device comprising first air deflection means to effect on the flying device on aerodynamically induced lift force directed upwardly when the device is flying horizontally, second air deflection means mounted for pivotal movement in a manner to modify the airstream over said first air deflection means thereby to vary the magnitude and/or direction of said lift force, and a pair of control lines operatively connected to said second air deflection means for effecting said pivotal movement thereof and for extension away from one side of the flying device, characterized in that each of the two opposite surfaces of said second air deflection means has a member projecting away therefrom, free ends of said two members being operatively connected to the two control lines respectively, and in that said pair of control lines pass respectively around a pair of like-dimensioned pulley wheels mounted coaxially on the device and from said coaxial pulley wheels in an unrestricted manner such as to extend away from said one side of the flying device in unkinked condition and at an angle to the direction of flight of the flying device, said angle being continuously variable independently of effecting pivotal movement of said second air deflection means.

4. A line controllable flying device according to claim 1, comprising fourth air deflection means to effect an aerodynamically induced turning force or moment upon said flying device in a direction tending to turn the flying device outwardly of the arcuate path of motion in which it is constrained to fly.

5. A line controllable flying device according to claim 3, wherein said two pulley wheels are mounted coaxially on said first air deflection means and forwardly of said second air deflection means.

6. A line controllable flying device comprising:

(a) a first air deflection means to effect on the flying device an aerodynamically induced "lift" force directed upwardly when said device is flying horizontally, (b) second air deflection means mounted for pivotal movement in a manner to modify the airstream over said first air deflection means thereby to vary the magnitude and/or direction of said "lift" force, (c) a pair of control lines operatively connected to said second air deflection means for effecting said pivotal movement thereof, said control lines passing over a pair of like-dimensioned pulley wheels mounted coaxially on said device and for extension away from one side of the flying device in an unrestricted and unkinked condition and at an angle to the direction of flight of the flying device, said angle being continuously variable independently of effecting pivotal movement of said second air deflection means, and (d) third air defelction means to effect an aerodynamically induced lateral force on the flying device in a direction extending away from the other side of the flying device and of a magnitude sufficient to augment substantially any tension force component in the control lines due to centrifugal force.

7. A line controllable flying device according to claim 6 wherein (i) a fixed offset rudder or so-called trailing edge is associated with said third air deflection means to effect an aerodynamically induced turning force or moment upon said flying device in a direction tending to turn the flying device outwardly of the arcuate path of motion in which it is constrained to fly, (ii) the area of said third air deflection means is of the order of approximately two-thirds that of the first air deflection means, (iii) the two coaxial pulley wheels are mounted on said first air deflection means with their common axis located at a position that is offset laterally towards said one side of the flying device and is forward of the second air deflection means and of the so-called "centre of pressure" of said third air deflection means, and (iv) each of the two opposite main surfaces of said second air deflection means has a member projecting away therefrom, the free ends of said two members are directly connected to the two control lines respectively, said control lines passing from said members to and around said two coaxial pulley wheels and from said pulley wheels in an unrestricted manner such as to extend as aforesaid away from said one side of the flying device.

8. A line controllable flying device according to claim 6, wherein the common axis of said co-axial pulley wheels is located on said first air deflection means at a position that is offset laterally towards said one side of the flying device and is forward of the second air deflection means and of the so-called "centre of pressure" of said third air deflection means.

9. A line controllable flying device comprising first air deflection means to effect on the flying device an aerodynamically induced lift force directed upwardly when said device is flying horizontally, second air deflection means mounted for pivotal movement in a manner to modify the airstream over said first air deflection means thereby to vary the magnitude and/or direction of said lift force, a pair of control lines operatively connected to said second air deflection means for effecting said pivotal movement thereof, a pair of like-dimensioned co-axial pulley wheels for enabling said control lines to pass respectively therearound and from said pulley wheels in an unrestricted manner such as to extend from one side of the flying device in unkinked condition and at an angle to the direction of flight of the flying device, said angle being continuously variable independently of effecting pivoted movement of said second air deflection means, third air deflection means to effect an aerodynamically induced lateral force on the flying device in a direction extending away from the other side of the flying device and of a magnitude sufficient to render any tensioning effect due to centrifugal force unnecessary to sustain flight of the flying device.

10. A flying device in accordance with claim 9 including fourth air deflection means to effect an aerodynamically induced turning force or moment upon said flying device in a direction tending to turn the flying device outwardly of the arcuate path of motion in which it is constrained to fly.

11. A flying device in accordance with claim 9 wherein the common axis of said co-axial pulley wheels is located on said first air deflection means at a position that is offset laterally towards said one side of the flying device and is forward of the second air deflection means and of the center of pressure of said third air deflection means.

* * * * *